US008097206B2

(12) United States Patent
Holzgruber et al.

(10) Patent No.: US 8,097,206 B2
(45) Date of Patent: Jan. 17, 2012

(54) LANCE DUCT FOR VACUUM TREATMENT SYSTEMS

(75) Inventors: Harald Holzgruber, Bruck a.d. Mur (AT); Michael Luven, Kempen (DE)

(73) Assignee: INTECO Special Melting Technologies GmbH, Bruck a.d. Mur (AT)

( * ) Notice: Subject to any disclaimer, the term of this patent is extended or adjusted under 35 U.S.C. 154(b) by 253 days.

(21) Appl. No.: 12/535,088

(22) Filed: Aug. 4, 2009

(65) Prior Publication Data

US 2010/0078862 A1 Apr. 1, 2010

(30) Foreign Application Priority Data

Oct. 1, 2008 (AT) ..... 1538/2008

(51) Int. Cl.
*C21C 7/10* (2006.01)

(52) U.S. Cl. ..... 266/226; 266/225

(58) Field of Classification Search ..... 266/225, 266/226

See application file for complete search history.

(56) References Cited

U.S. PATENT DOCUMENTS

| | | | |
|---|---|---|---|
| 3,669,437 | A | 6/1972 | Wernicke |
| 4,465,265 | A | 8/1984 | Kryczun et al. |
| 5,894,009 | A | 4/1999 | Luven |

FOREIGN PATENT DOCUMENTS

| | | | |
|---|---|---|---|
| DE | 3225772 | | 1/1984 |
| DE | 195 18 361 | | 8/1996 |
| JP | 09125131 A | * | 5/1997 |
| WO | 03/023073 | | 3/2003 |

OTHER PUBLICATIONS

Austrian Search Report for A 1538/2009.

* cited by examiner

*Primary Examiner* — Scott Kastler
(74) *Attorney, Agent, or Firm* — Bachman & LaPointe, P.C.

(57) ABSTRACT

For the metallurgical treatment of steel melts, a lance is guided through a guide tube with gland into a reaction chamber, on which a water-cooled connection with a connector flange and a vacuum-sealed housing with a housing flange are located, as well as a compensator installed between the housing and the gland guide tube for compensating lateral, axial or angular relative motions of the guide tube and housing during the course of movement.

5 Claims, 1 Drawing Sheet

LANCE DUCT FOR VACUUM TREATMENT SYSTEMS

BACKGROUND OF THE INVENTION

In the various methods for the metallurgical treatment of liquid metal or steel in a vacuum, tubular blow lances and/or burner lances are introduced into a vacuum chamber from the outside, vertically or diagonally from above, using a vacuum-sealed duct. The purpose of these lances is to introduce gases such as oxygen, argon, nitrogen or solids with a carrier gas into the steel melt located in the vacuum chamber.

Lances of this type are generally connected to a guide slide which can be displaced by a motor and by means of which the lance can be moved into the required operational position. A gland of a known, conventional construction, encompassing the lance, acts as a vacuum seal.

The position and alignment of the gland should be axially parallel to the slide path of the guide slide so as to allow undisturbed feeding-in and retraction of the lance. In reality there are deviations here, caused on the one hand by measurement and manufacturing tolerances and on the other hand by thermal distortion of the vacuum chamber cover, and so the lance axis does not always extend parallel to the slide path. Consequently, there are often high frictional forces between the lance surface and the gland, and these can cause the gland to become leaky or the slide drive to malfunction.

To avoid these serious drawbacks, DE 195 18 361 C1 suggests using a gland with a thin-walled metal compensator to thus compensate for deviations in the parallelism of the lance axis and the slide path. The lance duct with compensator according to the prior art disclosed in the above-mentioned patent is constructed in such a way that the same pressure prevails inside the compensator as in the treatment chamber, i.e. a vacuum prevails in the case of vacuum treatment, and the atmospheric external pressure acts on the outer wall of the compensator. The atmospheric pressure of approx. 3000 kg acting on the compensator from outside braces or deforms the compensator, greatly limiting or impeding the required flexibility thereof. Moreover, the high forces acting on the compensator in combination with axial and lateral deviations in the movement path of the lance can lead to the formation of ruptures in the compensator and thus to the failure thereof. Although the solution proposed in DE 195 18 361 C1 allows an improvement to be achieved as regards axis parallelism, it is nevertheless, as described above, susceptible to failure and thus not always reliable.

SUMMARY OF THE INVENTION

The present invention allowed the drawbacks and difficulties described above to be remedied in a surprisingly simple way, in that by virtue of the arrangement according to the invention of the compensator, in contrast to DE 195 18 361 C1, the internal walls of the compensator are loaded by the atmospheric pressure while the outer walls of the compensator are exposed to the internal pressure in the treatment chamber, i.e. to the vacuum. This makes it possible, instead of a metal compensator, to use a compensator made of temperature-resistant, flexible material such as rubber, with the advantage that it undergoes hardly any deformation caused by the internally acting atmospheric pressure.

DETAILED DESCRIPTION

Figure 1:
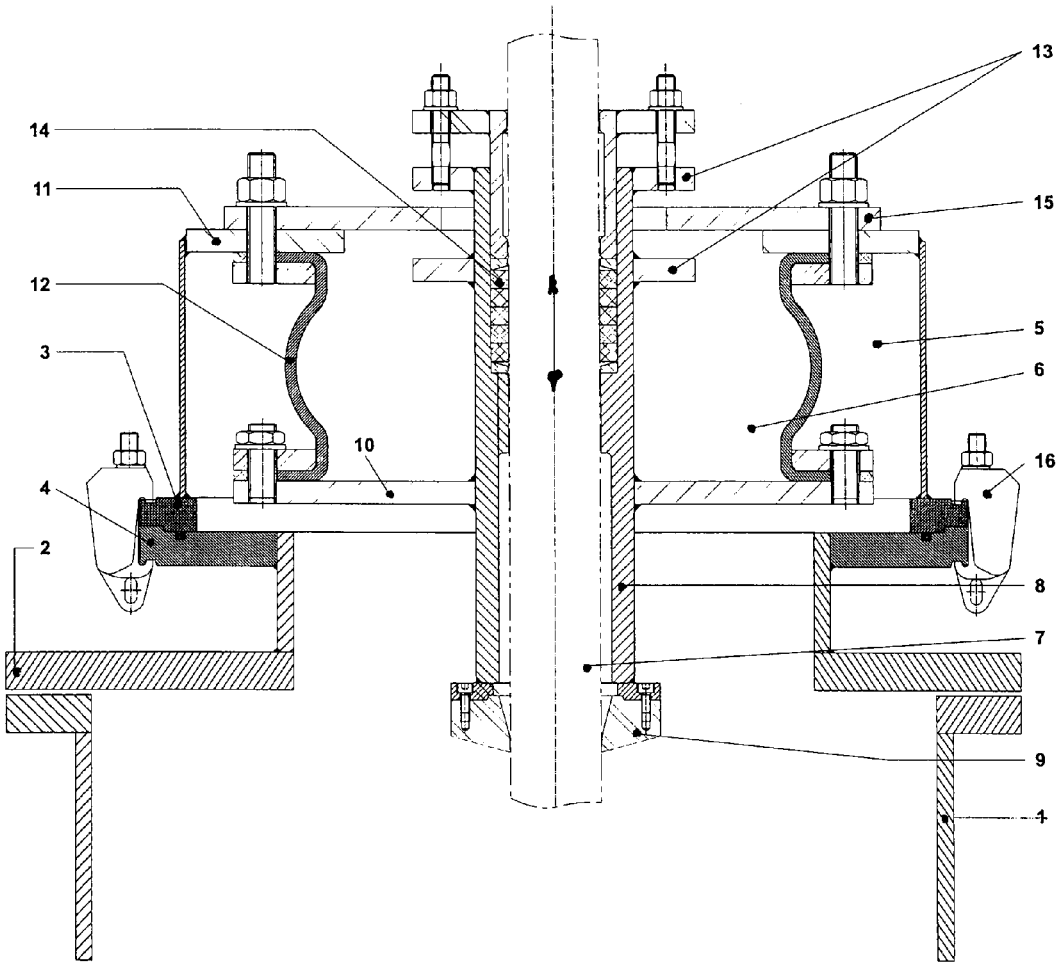
FIG. 1 shows a preformed embodiment of a lance duct according to the invention.

FIG. 1 shows a preferred embodiment of a lance duct according to the invention. The atmospheric pressure of approx. 1 kg/cm$^2$ arising in the interior (6) of the compensator (12) maintains the outwardly directed bellows shape in such a way as to provide a corresponding flexibility in the axial and the lateral direction. A stop plate (15), divided in two at the top, is screwed onto the upper flange (11) of the housing chamber (5) which is under vacuum, said flange also acting as an upper attachment flange for the compensator (12), the interior (6) of which is at atmospheric pressure. The upper stop plate (15) delimits the axial and lateral motion of the guide tube (8) with the lance (7) sealed up by a vacuum gland (14), on the one hand by means of two spacer rings (13) attached to the guide tube (8) and on the other hand by means of the gap between the stop plate (15) and the guide tube (8). This prevents overexpansion of the compensator (12) beyond the permissible tolerances in both the axial and the lateral direction. The compensator (12) is installed between the upper attachment flange (11) of the housing (5) disposed in the vacuum region and the lower attachment flange (10) which is attached to the guide tube (8). The housing chamber (5) is fixed by the lower flange (3) thereof to the flange of the connector (4), by means of bracket screws (16). As for the connector, this is screwed via a sealing flange (2) onto the flange of the water-cooled connection (1) attached to the cover of the vacuum chamber. A wedge-shaped scraper ring (9) is further attached to the lower end of the guide tube (8) by flange so as to be exchangeable. When the lance (7) moves upwards, this scraper ring (9) scrapes off any slag splashes or steel splashes adhering to the lance surface. Preferably, the scraper ring consists of a wear-resistant steel, for example manganese steel or the like.

A significant additional advantage of the proposed construction according to the invention lies in the simple form of the flexible compensator, with the external annular bellows shape thereof being promoted by the atmospheric internal pressure. In contrast to a thin-walled high-grade steel compensator with numerous folds, which necessitates a special venting connection for the avoidance or removal of dust deposits, the flexible compensator used in accordance with the invention is not sensitive to dust which settles through vents on the outer surface of the compensator.

The lance duct according to the invention is thus a device for introducing blow or burner lances, which are displaceable in an axial direction, into a vacuum-sealed reaction chamber for the purpose of metallurgical treatment of liquid metal or steel melts in a vacuum, which device basically consists of a guide tube (8) with gland (14) for guiding and sealing off the lance (7), a water-cooled connection (1) with connector flange (4), which connection is attached to the reaction chamber and connected thereto in terms of the vacuum prevailing therein, and a vacuum-sealed housing (5) with a housing flange (3), as well as a compensator (12) installed between the housing and the gland guide tube (8) for compensating lateral, axial or angular relative motions of the guide tube (8) and housing (5) during the course of movement of the lance. Thus, the characterizing features are the lower flange of the compensator (12), which is connected to a flange (10) attached to the movable guide tube (8) with gland (14), and the upper flange of the compensator (12), which is screwed onto the upper fixed housing flange (11) so that the internal annular space (6), formed between the compensator walls and the flanges on the one hand and the outer surface of the guide tube (8) on the other hand, is connected to the external air and is thus at atmospheric pressure, while the internal space (5) of the housing chamber, which space surrounds the compensator (12), is connected to the vacuum pressure prevailing in the reaction chamber.

A temperature-resistant flexible material may advantageously be used as the material for the compensator (12). Temperature-resistant rubber may in particular be used for this purpose.

To keep the mobility of the guide tube (8) of the gland (14) within desirable limits in the vertical direction, spacer rings (13), the external diameter of which exceeds the diameter of the stop plate on the housing, may be attached to the guide tube (8) above and below a stop plate (15), which is divided at least in two and is mounted on the upper mounting flange (11) of the housing.

On the other hand, the lateral mobility of the guide tube (8) of the gland is delimited by the gap which is present between the diameter of the duct opening of the stop plate (15), which is divided at least in two, and the external diameter of the guide tube (8).

It is further advantageous for a wedge-shaped scraper ring (9) which surrounds the blow lance (7) to be attached to the lower end of the guide tube (8) so as to be exchangeable, in such a way that when the lance is retracted, steel splashes or slag splashes adhering thereto are scraped off.

What is claimed is:

1. A device for introducing blow or burner lances, which are displaceable in an axial direction, into a vacuum-sealed reaction chamber for the purpose of metallurgical treatment of liquid metal or steel melts in a vacuum, comprises a guide tube (8) with gland (14) for guiding and sealing off the lance (7), a water-cooled connection (1) with connector flange (4), which connection is attached to the reaction chamber and connected thereto, and a vacuum-sealed housing (5) with a housing flange (3), as well as a compensator (12) installed between the housing and the gland guide tube (8) for compensating lateral, axial or angular relative motions of the guide tube (8) and housing (5) during the course of movement of the lance, a lower flange of the compensator (12) is connected to a flange (10) attached to the movable guide tube (8) with gland (14), and an upper flange of the compensator (12) is screwed onto an upper fixed housing flange (11) so that an internal annular space (6), formed between the compensator walls and the flanges on the one hand and the outer surface of the guide tube (8) on the other hand, is connected to external air and is thus at atmospheric pressure, while the internal space (5) of the housing chamber, which space surrounds the compensator (12), is connected to the vacuum pressure prevailing in the reaction chamber.

2. A device according to claim 1, wherein the installed compensator consists of a flexible material.

3. A device according to claim 1, wherein mobility of the guide tube (8) of the gland (14) is delimited in the vertical direction by spacer rings (13), the external diameter of which exceeds the diameter of the stop plate on the housing, and which are attached to the guide tube (8) above and below a stop plate (15), which is divided at least in two and is mounted on the upper mounting flange (11) of the housing.

4. A device according to claim 1, wherein lateral mobility of the guide tube (8) of the gland is delimited by the gap which is present between the diameter of the duct opening of the stop plate (15), which is divided at least in two, and the external diameter of the guide tube (8).

5. A device according to claim 1, wherein a wedge-shaped scraper ring (9) surrounds the blow or burner lance (7) and is attached to the lower end of the guide tube (8).

* * * * *